US005622160A

United States Patent [19]

Casas Salva

[11] Patent Number: 5,622,160

[45] Date of Patent: Apr. 22, 1997

[54] GAS-POWERED GUNS OF THE REVOLVER TYPE

[75] Inventor: Francisco Casas Salva, Sant Boi de Llobregat, Spain

[73] Assignee: Industrias el Gamo, S.A., Sant Boi de Llobregat, Spain

[21] Appl. No.: 534,332

[22] Filed: Sep. 27, 1995

[30] Foreign Application Priority Data

Sep. 27, 1994 [ES] Spain ..... 9402083

[51] Int. Cl.[6] ..... F41B 11/06

[52] U.S. Cl. ..... 124/76; 124/59; 124/74

[58] Field of Search ..... 124/48, 59, 73, 124/74, 76; 33/233

[56] References Cited

U.S. PATENT DOCUMENTS

| | | | |
|---|---|---|---|
| 3,119,384 | 1/1964 | Merz | 124/74 X |
| 3,193,932 | 7/1965 | Johnson | 33/233 |
| 3,612,026 | 10/1971 | Vadas et al. | 124/74 X |
| 3,945,142 | 3/1976 | Keppeler | 33/233 X |
| 4,422,433 | 12/1983 | Milliman | 124/74 |
| 4,651,432 | 3/1987 | Bornancini | 33/233 |
| 4,669,193 | 6/1987 | Moore | 33/233 X |
| 4,848,307 | 7/1989 | Tsao | 124/59 |
| 5,160,795 | 11/1992 | Milliman | 42/65 |
| 5,186,156 | 2/1993 | Clayton | 124/59 |
| 5,208,407 | 5/1993 | Stover | 33/233 X |
| 5,285,766 | 2/1994 | Milliman | 124/72 |
| 5,400,536 | 3/1995 | Milliman | 124/74 X |
| 5,509,399 | 4/1996 | Poor | 124/76 |

FOREIGN PATENT DOCUMENTS

| | | |
|---|---|---|
| 0367676 | 5/1990 | European Pat. Off. . |
| 2179429 | 3/1987 | United Kingdom . |

*Primary Examiner*—John A. Ricci
*Attorney, Agent, or Firm*—Jacobson, Price, Holman & Stern, PLLC

[57] ABSTRACT

Improvements in gas-powered guns of the revolver type. The gun includes a barrel (10), a revolving projectile loader (11) by way of a revolver drum tiltable to one side into a loading position, a rearsight holder (14) bearing a sight (15) which is adjustable positioned by a screw (16), a striking hammer (17) rotationally actuated by a trigger (18) and a grip frame (19) housing a compressed-gas cartridge (20) whose nozzle leans against a seal (21). According to the improvements, a casing (24) moulded on the barrel (10) has an upper expansion (**24*a*) which positionally secures a portion of the rear sight holder (14). The revolving projectile loader (11) is constituted by two pieces obtained by moulding, a first piece (29) comprising a series of tubular elements (30) provided to accommodate the projectiles and to transfer them to the barrel (10), and a second piece (32) constituting a casing and receiving in its inside the former one in a plug-in engagement. The rearsight holder (14) is provided with a mechanism for facilitating quick assembly thereof. A hammer (17) is formed by two halves (17*a*, 17*b***) detachably attached to each other.

14 Claims, 3 Drawing Sheets

GAS-POWERED GUNS OF THE REVOLVER TYPE

BACKGROUND OF THE INVENTION

The present invention refers to improvements in the gas-powered guns of the revolver type, through the application of which important advantages of constructional, operational and practical character are obtained over the guns of this type which are known so far. The gun as per the invention proposes in particular the construction of a series of mouldings advantageously made of plastics material, as well as of some of its pieces comprising metal inserts in the mouldings, and of some other compound pieces comprising two parts of different characteristics, all this in order to reduce the manufacturing costs.

Known gas-powered guns of the type to which the present invention relates are described in U.S. Pat. No. 4,422,433 and U.S. Pat. No. 5,160,795, GB Patent No. 2,179,429 and EP Patent No. 0367,676.

BRIEF SUMMARY OF THE INVENTION

The improvements of this invention concern in the first place to the revolving part of the gun or revolving projectile loader which, instead of being a simple disc, as for example in the gas-powered gun described in cited U.S. Pat. No. 4,442,433, consists in a cylindrical body in which the length predominates over the diameter, which gives the article a more realistic look. For this purpose and taking into account that said loader is according to the invention supposed to be obtained by moulding and advantageously of plastics material, in order to facilitate the manufacture, save material, make the process more economical and guarantee the required accuracy in the finished piece a structure is proposed for said loader consisting of a first piece bearing a series of tubular elements which are distributed in a circle, equispaced, parallel to the rotation axis and perfectly adjustable in coaxiality facing the barrel hole through rotation of the assembly, and a second piece engaged on the former one by way of casing and attached to it, with an outside look like that of the drum of a conventional gun.

These improvements concern as well the characteristics of the rearsight holder, and more precisely some means for the quick assembly of said rearsight on a setscrew to notably simplify and lower the cost of said assembly. For this purpose said rearsight, instead of being integral with a block with a threaded through hole through which a setscrew is arranged for the positioning by shifting when turning said screw, as per a conventional structure, is now integral with a piece in the shape of a channel-shaped clamp which is capable of fitting into a complementary channel-shaped hollow provided in the rearsight holder, said channel-shape, which is obtained by moulding, presenting a threaded sector which is engageable, by simple insertion into the cavity between its flanks, with a setscrew for the shifting and fixing of said rearsight. The rearsight/screw subassembly is in this way assembled in a very quick manner, and its association with the rearsight holder is as well very simple.

A characteristic of these improvements is as well the assembly of the rear sight holder on the revolver, which is very simple, said rear sight holder comprising for such a purpose an end portion which is distal from the rearsight, is situated at a lower level (said end portion presenting for such a purpose an offset) and has lateral tabs which fit into opposed throats situated directly above a hole for the assembly of the barrel, which in its turn presents an upper expansion formed from a casing of plastics material moulded on said barrel, said expansion blocking said tabs in the assembly position of the barrel. Moreover, said end portion of the rear sight holder has a through hole provided to receive through it a screw for the clamping of the barrel and which in its turn fastens the rear sight holder, which is thus directly attached to the gun body thereby extending on its upper part.

These improvements concern as well the construction of the hammer, which consists here of two pieces which are namely a heavier one provided for the purpose of striking, and a second one provided to serve as a support and hinged connection means and made out of a plate with several bendings, and they also concern a particular structure and assembly of an appendage by way of nose associated with the trigger of the gun and provided to rotationally actuate said hammer.

A protuberant configuration has been as well provided including a flat and a ramp ending the upper part of the hammer, so as to allow to insert the transversal bolt which acts as a safety bolt and has a complementary flat and ramp, with no need to raise said hammer to carry out said operation.

Also characteristic of the improvements to which the invention refers is the way to attach the handle plates of the gun to the grip frame, at least one of said handle plates being removable in order to facilitate the replacement of a compressed-gas cartridge such as a $CO_2$ cartridge equipping the assembly.

The revolving projectile loader can be tilted to the loading position as per a structure known in itself, but in the proposed gun the support and tilting member comprises a main portion of moulded plastics material in which are inserted the ends of two pins extending to the outside and parallel to each other, one of them serving as a hinged connection with the gun body, and the second one serving for the mounting of said loader in a rotatable condition.

According to the improvements proposed by the invention one or more holes have been lastly provided in the gun described herein underneath the seal applied against the nozzle of the $CO_2$ cartridge, so that if said $CO_2$ cartridge were removed while still containing a given volume of gas the latter can flow to the outside without unfavourably affecting said seal.

The above and other objects, advantages and features of the present invention will become apparent from the following description of certain preferred embodiments thereof.

BRIEF DESCRIPTION OF THE DRAWINGS

The invention will now be described in detail with reference to the accompanying drawings wherein.

DETAILED DESCRIPTION

Figure 1:
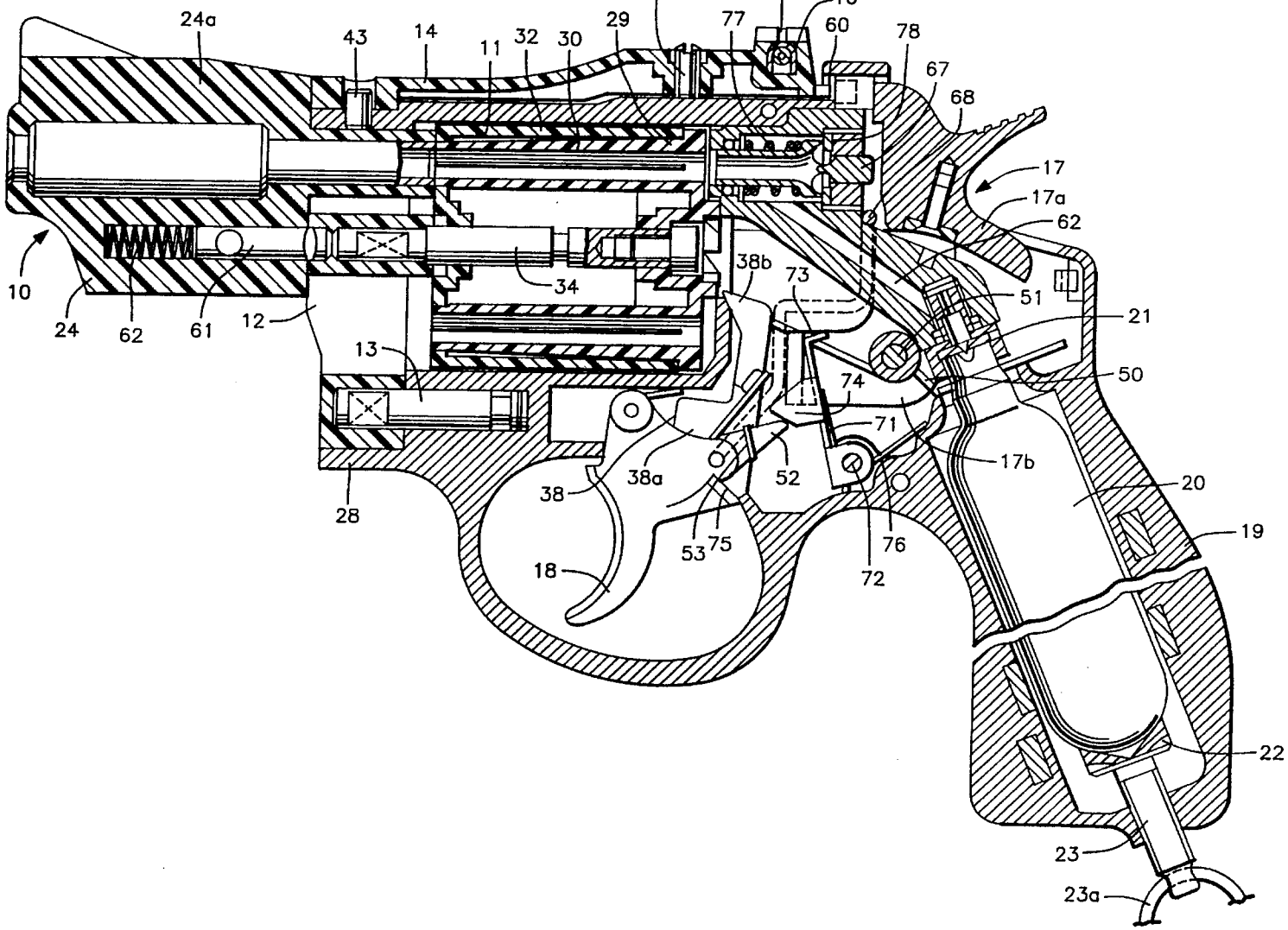
FIG. 1 is a longitudinally sectional view of a gas-powered revolver incorporating the described improvements.

The gas-powered gun to which these improvements are applied, which is shown in said FIG. 1, comprises a barrel 10, a revolving projectile loader 11 by way of a revolver drum tiltable to one side into loading position because of being associated with a support 12 which is tiltable around a pin 13, a holder 14 bearing a sight 15 which is adjustably positioned by a screw 16, a striking hammer 17 rotationally actuated by a trigger 18 and a grip frame 19 housing a $CO_2$ cartridge 20 whose nozzle leans against a seal means 21 and whose bottom rests on a cup-shaped rest 22 linked to a stem 23 which is threadingly engaged in the body of said grip frame 19 and ends in a (partially illustrated) grip 23*a*, all this as per a structure which is in itself conventional in this kind of guns. The revolving loader 11 is maintained in its firing position (FIG. 1) through the actuation of a catch 61 housed in the barrel casing 24 and loaded by a spring 62 to lock the tiltable member 12 which supports said loader 11. Said catch 61 has an appendage (not shown) which is accessible from the outside for its retraction by compressing the spring 62.

In accordance with the improvements of this invention, gun barrel 10 has a casing 24 made of plastics material which presents an upper expansion 24*a* which positionally secures the rear sight holder 14, and more precisely blocks an end portion 14*a* thereof which is distal from the rearsight 15 and ends in lateral tabs or flanges 25 (see FIG. 4) which fit into a seat defined by two opposed throats 26 flanking a central recess 27 of a width equivalent to that of body 14 whose portion 14*a* is inserted in said seat 26, 27 whereby body 14 is attached to the top or back of gun body 28 thereby longitudinally extending thereon, as can be seen in FIG. 1.

The rear sight holder 14, advantageously made of plastics material, has in the area of portion 14*a* a through hole 46 through which a screw 43 is arranged to threadingly engage in a boring provided in gun body 28 and to press on casing 24 made of plastics material and moulded on barrel 10 thus firmly attaching it to the gun. As it can also be seen in FIG. 1, a second screw 44 threads its way into a prismatic hole 45 which is provided in the rear sight holder 14 and whose shape facilitates the self-tapping penetration of said screw 44 whose end rests on the top of gun body 28 thus allowing to lift body 14 to a bigger or lesser extent with respect to said top part of the gun. A lug 59 limits the lift of said body 14 as it is arranged in a rear pocket 60.

According to these improvements the projectile loader 11 revolving around pin 34 adopts a cylindrical configuration with a length sensibly bigger than the diameter, and is formed by two pieces which are both obtained by moulding advantageously of plastics material and which are namely a first piece 29 comprising a series of tubular elements 30 to receive the projectiles (which are not shown) and to transfer them to barrel 10, said tubular elements 30 being integral with a discoidal portion 31, and a second piece 32 which constitutes a casing and receives in its inside the former one in a plug-in engagement.

Tubular elements 30 are parallel to each other and to swivel pin 34 and the axis of barrel 10, in order to allow an indexed and coaxial adjustment with respect to the hole of said barrel by revolving the assembly. Said tubular elements 30 are integral with a discoidal portion 31 in which they end through a plurality of circular holes 33 distributed in an equispaced way next to its periphery to admit the ammunition which is retained in its seat in the initial part of said tubular elements 30 directly close to hole 33 with the aid of longitudinal ribs 63 which can be seen in FIG. 2 and of which 3 are advantageously provided. The discoidal portion has on its circular outer surface a central toothing 35 provided to be driven by engagement with a ratchet 36, and a second peripheral toothing 37 determining a rotation end stop configuration with respect to one of the faces 38*a* of a portion 38 of ratchet 36 ending in a ratchet pawl 38*b*.

Figure 2:
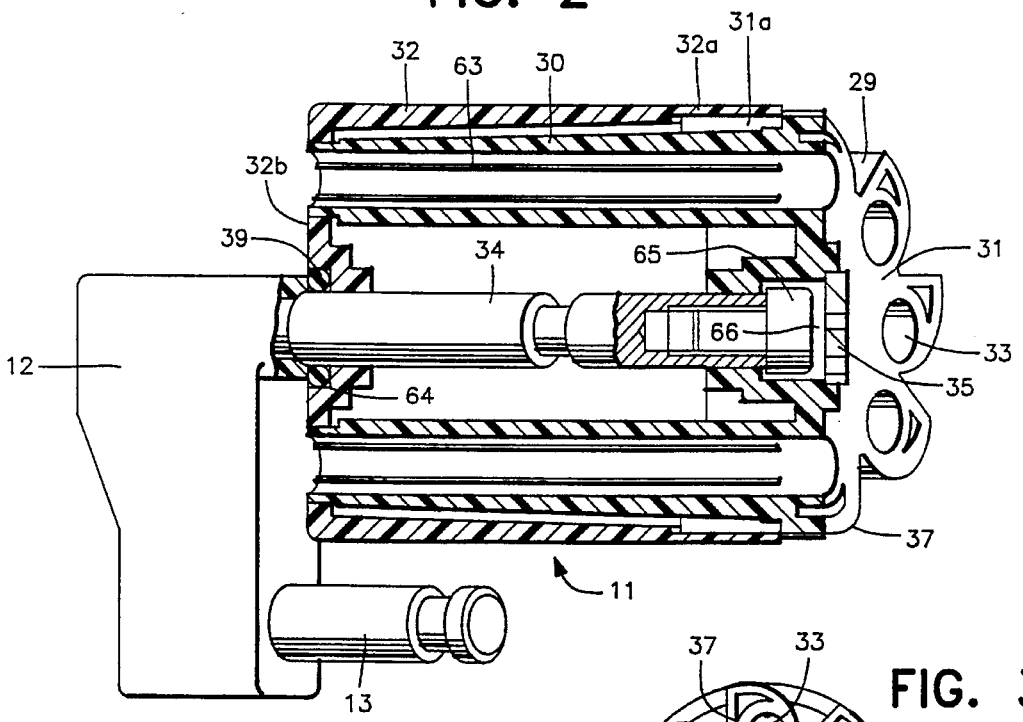
FIG. 2 is a perspective view of the diametrically sectioned revolving loader or drum including the support or hinge for its lateral tilting.
Figure 3:
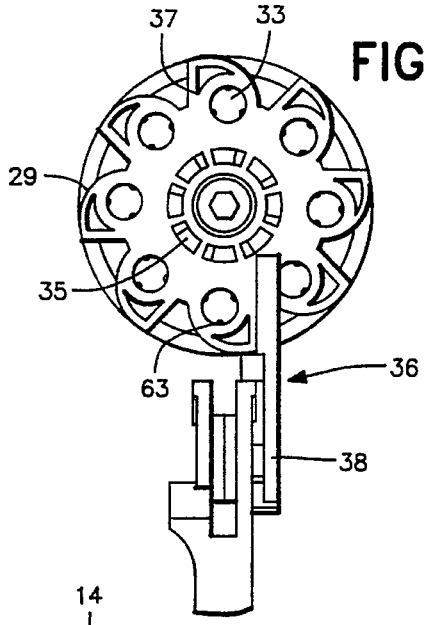
FIG. 3 is an elevational view of the back of said revolving loader showing the ratchet mechanism for its rotational indexing.

The attachment of cylindrical casing or shell 32 is carried out in the embodiment shown in FIG. 2 by fitting and locking an engaging mouth portion 32*a* by elastic deformation and locking with an anchoring profile 31*a* constituted by the bearing edge of discoidal portion 31. The mutual attachment of pieces 29 and 32 could be achieved in an alternative way by simply arranging an adhesive on the correspondent profile between both pieces.

As can be seen in said FIGS. 1 and 2, in a central hole of the bottom 32*b* of the casing 32, for the passage of pin 34 rotatably supporting the revolving loader 11 there is a ring-shaped recess 64 housing a seal means 39 determining a friction on said pin in order to brake the loader to thus immobilize it during the back motion of ratchet 36 thus preventing its motion by friction with part 38 of said ratchet in its return travel. In these same FIGS. can also be seen that the support member 12 is carried out as a moulded block out of plastics material in which said pins 13 for the hinged connection and 34 for the revolving of loader 11 are inserted. The attachment of revolving loader 11 to its swivel pin 34 is carried out by means of a screw 65 housed in a central recess 66 of said discoidal portion 31.

Figure 4:
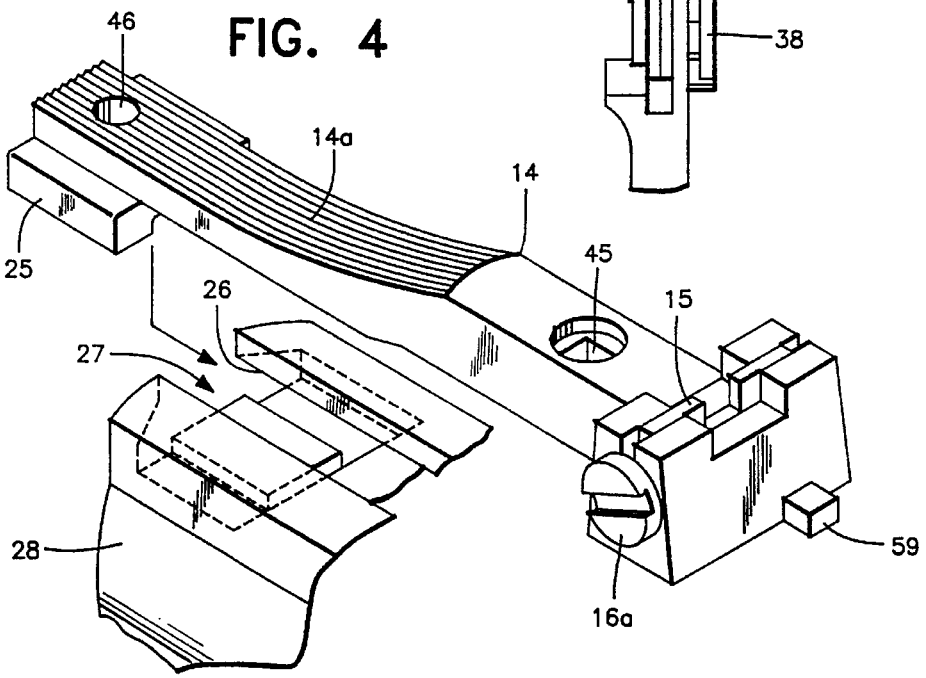
FIG. 4 is a conventional perspective view of the rear sight holder with the detail of the assembled rearsight and also showing the upper front part of the gun body into which an end of said rear sight holder is to be fitted.
Figure 5:
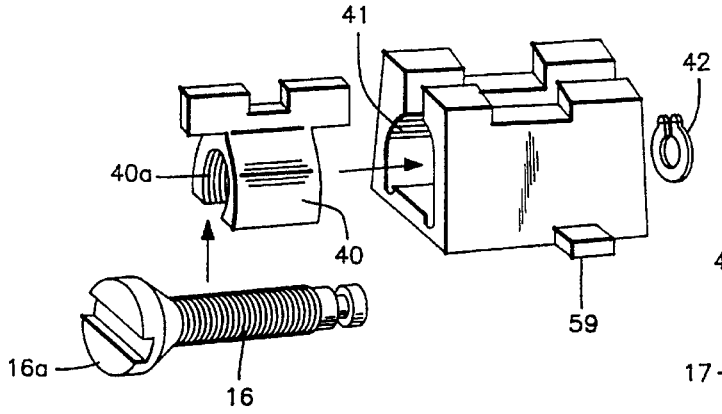
FIG. 5 is a perspective view detailing the rearsight quick assembly means.

In FIGS. 4 and 5 can be seen the rearsight 15 quick assembly means consisting of a moulding advantageously made of plastics material in the shape of a channel-shaped clamp 40 integral with said rearsight 15 and having an inner curved sector 40*a* with a thread capable of riding on set-screw 16 ending in driving head 16*a*, in such a way that the assembly formed by channel-shaped clamp 40 and screw 16 is obtained by simple insertion of the latter into portion 40*a* of the former whose flexion allows said insertion, and both are thereupon introduced into a hollow 41 of the rear sight holder 14 and the screw is axially immobilized, for example, by a snap ring 42 or by another suitable retaining means or configuration.

The striking hammer 17 of the gun is formed (see FIG. 6) by two pieces 17*a* and 17*b* which are advantageously attached to each other by a screw 47.

The first 17*a* of said pieces is provided to strike on a valve 67 provided to open the passage of gas through the intermediation of an element 68 (shown in FIG. 1) in the shape of a rod linked to the trigger 18, in such a way that the striking action of portion 17*a* of hammer 17 on said valve 67 is only possible through the action of the trigger 18 and cannot take place because of an accidental blow on the hammer, the use of said rod 68 and its constructional structure being conventional in these gas-powered guns.

Figure 6:
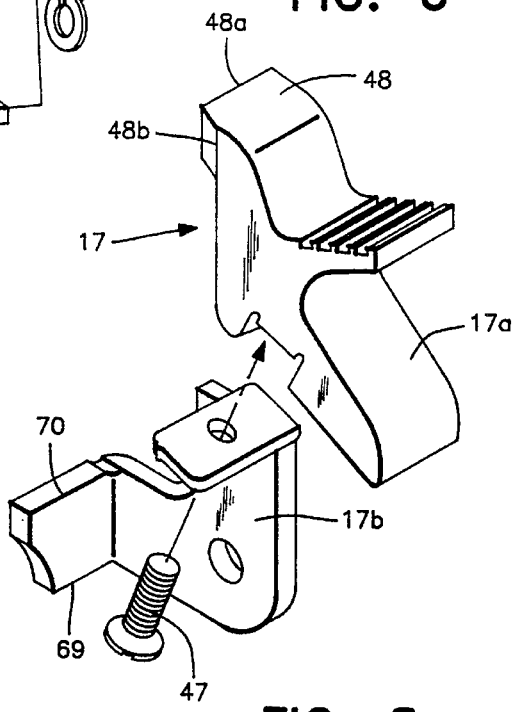
FIG. 6 is a perspective view of the assembly formed by the striking hammer and its support.
Figure 8A:
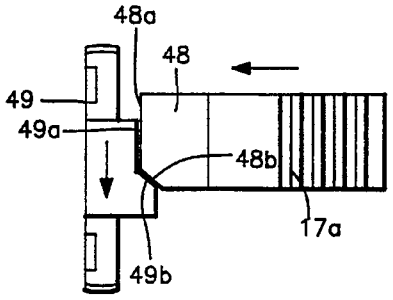
FIGS. 8*a* and 8*b* illustrate in plan-view the particular configuration of the operative portion of a transversal bolt acting as a safety bolt as proposed, as well as the way in which said bolt acts on the striking hammer in two operative positions, in the second one blocking said hammer.
Figure 8B:
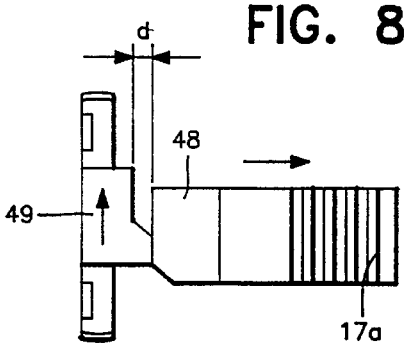

Hammer 17 ends at the top in a protuberance 48 presenting a flat portion 48*a* followed by a ramp 48*b*, and an equivalent configuration formed by a flat 49*a* and a ramp 49*b* appears at the end of a transversal bolt 49 acting as a firing safety bolt (see FIGS. 6 and 8*a*, 8*b*). Such a configuration allows that by arranging said bolt 49 in a hammer blocking position said hammer 17 can be moved away and kept at a sufficient distance "d" from its striking plane without the user having to previously raise said hammer or to load the spring 50 which is associated with the swivel pin 51 of said hammer 17.

The second 17*b* of said pieces forming the hammer 17 and shown in FIG. 6 is an actual support and has been obtained from a piece of plate and by means of several bendings, and said piece is associated with said swivel pin 51 and is raised by a driving nose 52 associated with trigger 18 with the interposition of a return spring 53 (see FIG. 1) which allows said nose 52 to pivotally bend thus passing edge 69 of portion 17*b* of the hammer 17 in its return travel, thus facilitating the return of trigger 18 to a rest position.

Figure 7:
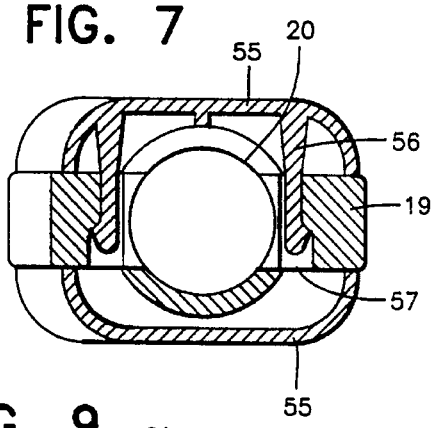
FIG. 7 is a cross-sectional view of the grip frame of the gun detailing the means for the removable assembly of one of the handle plates.

As shown in FIG. 7, the handle plates 55 of grip frame 19 are attached to said grip frame by means of appendages 56, and said appendages are engaged by snug insertion and elastic deformation in pockets 57 of the grip frame 19, in at least the appendages 56 of one of the handle plates their end configuration being such that it allows to remove them from their pockets. A second handle plate 55 is generally provided with appendages ending in a harpoon-like configuration and which are not removable (these latter appendages not having been illustrated.

Figure 9:
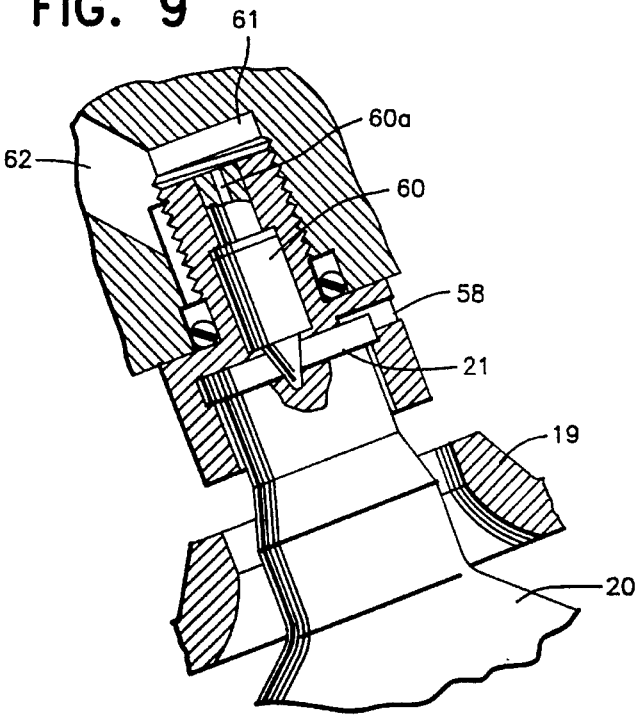
FIG. 9 lastly shows a partial section of the leaning on the gun of the end of the compressed-gas cartridge, where in accordance with the related improvements holes have been provided for the derivation of residual pressures in case of disassembly of said $CO_2$ cartridge.

FIG. 9 shows that surrounding the seal 21 against which the end of the nozzle 20*a* of the $CO_2$ cartridge 20 is applied there is a hole 58 for the derivation therethrough of any flow of residual compressed-gas eventually remaining in the $CO_2$ cartridge 20 when carrying out its replacement. An eventual deterioration or loss of said seal 21 is in this way prevented. The seal 21 is penetrated by punctured pin 60 including an axial passage 60*a* communicating with chamber 61 and channel 62.

In FIG. 1 is also lastly shown a piece 71 known in itself which serves to block hammer 17 in the simple-action firing modality, according to which, as is well known, said hammer 17 is cocked without operating the trigger 18, and when acting on the latter thereby slightly shifting it backwards when going to fire the loader 11 completes its revolving motion and said hammer 17 is released, this allowing a better control of the gun by minimizing the necessary effort to be exerted on the trigger 18. As opposite to this, in the double-action way of operation when actuating the trigger 18 the loader 11 revolves up to the firing position, the hammer 17 is cocked and is then finally released to strike on the valve 67, but this entails a bigger effort on the trigger 18, which is the member that conducts the whole operation.

In the case of the single-action modality, when raising the hammer its portion 70 of support 17*b* drives rod 68 which shifts trigger 18 backwards, and the latter in its turn and by means of portion 38 of ratchet 36 and its pawl 38*b* engages toothing 35 and revolves the revolving loader up to a position close to that wherein a tubular element 30 is facing barrel 10. To block hammer 17 in said position said piece 71 is employed which pivots on pin 72 and is provided with a bending 73 provided to lock piece 17*b* once it has turned passing said bending 73. Piece 71 has besides an ear 74 which will be directly actuated by a lateral protuberance 75 of trigger 18, and which when thus actuated moves said piece 71 overcoming the action of its spring 76, hammer 17 being then thus released while the final backward shifting of trigger 18 produces a final turning of loader 11 and thus the alignment of tubular element 30 with barrel 10, whereupon the firing takes place.

The closing of valve 67 is assured by a spring 77 pressing it against its seal 78, all this also according to a conventional structure.

I claim:

1. Improvements in gas-powered guns of the revolver type, including a barrel, a revolving projectile loader by way of a revolver drum tiltable to one side into loading position associated with a support which is tiltable around a pin, a rearsight holder bearing a rearsight which is adjustably positioned by a setscrew, a striking hammer rotationally actuated by a trigger and a grip frame with handle plates housing a compressed gas cartridge having a nozzle which leans against a seal means said improvements comprising:

a casing of plastics material moulded on said barrel said casing having an upper expansion which positionally secures said rearsight holder at an end portion thereof which is distal from said rearsight;

a revolving projectile loader having a cylindrical configuration wherein the length predominates over the diameter, and being constituted by two pieces obtained by moulding, a first piece comprising a series of tubular elements provided to accommodate projectiles and to transfer them to said barrel, said tubular elements being integral with a discoidal portion, and a second piece constituting a casing and receiving in its inside the former one in a plug-in engagement;

a rearsight holder being provided with means for a quick assembly of said rearsight on said setscrew;

a hammer being formed by two halves detachably attached to each other, one of them being provided for striking a gas valve release means, and the other one acting as a support and means for hingedly connecting said hammer to a gun body;

grip frame handle plates having appendages moulded integrally therewith, said appendages being connectable to said grip frame to secure said grip frame handle plates to the grip frame.

2. Improvements as claimed in claim 1, wherein:

said first piece forming said revolving projectile loader consists of said discoidal portion which has a plurality of through holes distributed in a circle and equispaced next to its periphery and continued in said tubular elements which are parallel to a swivel pin axis of said revolving projectile loader and also parallel to a bore axis of said barrel in firing position;

said tubular elements are coaxially adjustable with respect to said bore of said barrel by revolving said projectile loader;

said discoidal portion integrating in a surface which is opposed to said tubular elements a toothing provided to be driven by engagement with a ratchet;

a second peripheral toothing on said discoidal portion determining a rotation end stop configuration, said second piece provided by way of casing is formed by a cylindrical shell which is adequately dimensioned to receive by plug-in insertion the former one to which it is attached through its engaging mouth portion; and both said first and second pieces comprising corresponding central holes for their association with said swivel pin.

3. Improvements as per claim 2, wherein said two pieces forming said revolving projectile loader are locked together by fitting and locking an engaging mouth portion thereof by elastic deformation and locking with an anchoring profile constituted by a bearing edge of said discoidal portion.

4. Improvements as per claim 2, wherein said two pieces forming said revolving projectile loader are locked together by insertion and arrangement of an adhesive on the mutually contacting parts of both pieces.

5. Improvements as per claim 2, wherein:

a ring-shaped recess is provided bordering said central hole of said second piece for the passage of said swivel pin rotatably supporting said revolving projectile loader, said ring-shaped recess housing a seal means determining a friction on said swivel pin in order to brake said revolving projectile loader to thus immobilize it during a back motion of said ratchet.

6. Improvements as per claim 1, wherein said means for a quick assembly of said rearsight comprise:

a piece which is integral with said rearsight and has a shape like a channel-shaped clamp having an inner curved sector with a moulded thread;

said clamp being shiftable through a hollow of said rearsight holder through the association with said clamp of a screw which is inserted between the flanks of said channel-shape clamp, extends throughout said hollow and is axially immobilized at one of its ends by an element for securing it to said rearsight holder.

7. Improvements as per claim 1, wherein:

said rearsight holder is attached to said gun body by means of a front end portion thereof which is distal from said rearsight, is at a lower level and has lateral tabs which fit into opposed throats situated directly above a hole for the assembly of said barrel;

said upper expansion of said casing blocking said tabs in an assembly position; and said front end portion of said rearsight holder having a through hole provided to receive through it a screw for the clamping of said barrel and of said rearsight holder, which is thus attached to the top of the gun thereby extending thereon.

8. Improvements as claimed in claim 1, wherein said hammer consists of two pieces which are integral, a heavier one provided for the purpose of striking said gas valve release means, and a second one provided to serve as said support and said means for hingedly connecting the hammer to the gun body.

9. Improvements as claimed in claim 8, wherein said second piece is made out of a plate with several bendings, one of said bendings forming a protruding part which can contact with a driving nose associated with said trigger of the gun and provided to rotationally actuate on an appendage of said hammer.

10. Improvements as claimed in claim 9, wherein said driving nose is assembled in such a way that it can pivot in only one sense around a pin in order to allow the return of the trigger to its rest position, said driving nose being provided with a return spring.

11. Improvements as claimed in claim 1, wherein:

said handle plates of said grip frame are attached to said grip frame by means of said appendages, and said appendages are engaged by snug insertion and elastic deformation in pockets of said the grip frame; and the appendages of at least one of said handle plates have an end configuration being such that it allows to remove them from said pockets.

12. Improvements as claimed in claim 1, wherein said support of said revolving projectile loader allowing to tilt it laterally consists of a first part which is obtained by moulding and in which are inserted the ends of two metal pins, one of them serving as a hinged connection with a gun body, and the second one extending through an assembly formed by the two pieces defining said revolving projectile loader.

13. Improvements as claimed in claim 1, wherein a hole has been arranged surrounding a seal against which the end of said nozzle of said compressed-gas cartridge is applied, said hole providing a derivation therethrough of any flow of residual compressed-gas eventually remaining in said cartridge when carrying out its replacement.

14. Improvements as claimed in claim 1, wherein said hammer ends at the top in a protuberance presenting a flat portion followed by a ramp, and there is an equivalent configuration formed by a flat and a ramp at the end of a transversal bolt acting as a firing safety bolt, such a configuration allowing arranging of said bolt in a hammer blocking position without a user having to previously raise said hammer.

* * * * *